United States Patent [19]

Langford, Jr.

[11] 3,948,330

[45] Apr. 6, 1976

[54] VACUUM, VACUUM-PRESSURE, OR PRESSURE REVERSE CIRCULATION BIT

[75] Inventor: James Wilson Langford, Jr., Red Oak, Tex.

[73] Assignee: Dresser Industries, Inc., Dallas, Tex.

[22] Filed: Feb. 18, 1975

[21] Appl. No.: 550,492

[52] U.S. Cl. ..... 175/339; 175/213; 175/215

[51] Int. Cl.[2] ..... E21B 9/08

[58] Field of Search ..... 175/215, 330, 212, 213, 175/339, 340, 60, 69

[56] References Cited

UNITED STATES PATENTS

| | | | |
|---|---|---|---|
| 2,234,454 | 3/1941 | Richter | 175/215 |
| 3,292,719 | 12/1966 | Schumacher | 175/339 |
| 3,416,617 | 12/1968 | Elenburg | 175/339 |
| 3,416,618 | 12/1968 | Kunnemann | 175/339 |
| 3,419,092 | 12/1968 | Elenburg | 175/339 X |
| 3,542,144 | 11/1970 | White | 175/339 |
| 3,648,788 | 3/1972 | McKinney | 175/69 X |

*Primary Examiner*—John E. Murtagh
*Assistant Examiner*—Richard E. Favreau
*Attorney, Agent, or Firm*—Eddie E. Scott

[57] ABSTRACT

Drill cuttings are effectively removed from the bottom of a bore before they can adversely affect the operation of the bit. The bit includes a body member rotatably supporting individual cutter members. A shield means projects from the body member proximate the cutter members. A first portion of the shield means has an outside diameter substantially equal to the outside diameter of the cutter means and substantially equal to the diameter of the bore and a second portion having an outside diameter substantially less than the outside diameter of the cutter members and substantially less than the diameter of the bore. A first passage extending through the bit is adapted to provide communication with a vacuum source to assist in removing the drill cuttings. A second passage extending through the bit is adapted to provide communication with a gas pressure source to assist in removing the drill cuttings.

3 Claims, 3 Drawing Figures

VACUUM, VACUUM-PRESSURE, OR PRESSURE REVERSE CIRCULATION BIT

BACKGROUND OF THE INVENTION

The present invention relates to the art of earth boring and, more particularly, to an earth boring bit adapted for boring in varying formations. The present invention is ideally suited for boring relatively large diameter holes.

A need exists for an earth boring bit that will operate effectively in a wide range of formations and that will bore a relatively large diameter hole. Provisions must be made for removing the drill cuttings from the borehole as the drilling operations proceeds. For example, the ongoing construction of the Alaskan pipeline involves the boring of holes at periodic intervals through the tundra, permafrost and varying formations, and the grouting-in of long piles upon which elevated supports will be constructed to suspend the pipeline above the surface of the ground.

The environment for the boring of the aforementioned holes is extremely hostile, both because of the climate conditions and the geological conditions. Due to the destructive effect heavy vehicles have on the tundra, construction of the pipeline is limited to the time during the winter months when the tundra is frozen hard and less susceptible to damage from the heavy vehicles. The extreme cold affects properties of men, machines and materials and hampers drilling conditions. Metals which are tough and strong at normal temperatures become brittle and weak at the extremely low temperatures encountered. Motor oil turns into an almost solid mass. Elastomerics and plastics for the most part become brittle and weak.

The geological formations encountered in the boring of the aforementioned holes require a bit that is adapted for drilling through a wide range of formation characteristics. In many places the formations consist of unconsolidated materials involving large boulders, frozen and unfrozen water and other adverse conditions. Because the same bit will be used to drill a large number of holes along a length of the pipeline, the bit will be expected to encounter widely varying drilling conditions. The drill cuttings and debris must be removed from the borehole and properly controlled to prevent contamination of the environment. The drill cuttings must be lifted off bottom in order that they may become entrained with the flow of fluid through the drill string. The wall of the borehole must remain intact even in the presence of intruding water.

Conventionally, drilling is conducted by forcing a drilling fluid downward through the interior of the drill string wherein it passes through a multiplicity of nozzles passing onto or adjacent to the cutters to the bottom of the borehole, gathering cuttings and debris and carrying the cuttings and debris upward in the annulus between the wall of the drill string and the wall of the borehole. The drilling fluid may be air or some type of liquid drilling mud. An example of this type of drilling is shown in U.S. Pat. No. 3,087,558 to W. J. Dougherty, Jr., patented Apr. 30, 1963. It is also known to drill by what is known as a reverse circulation drilling system. This type of system is described in U.S. Pat. No. 3,416,617 to W. D. Elenburg patented Dec. 17, 1968. Drilling fluid is forced downward between the walls of dual concentric drill pipes until it reaches the bottom of the well bore and subsequently travels upward in the central annulus of the drill string carrying the cuttings and debris to the surface.

Description of Prior Art

In U.S. Pat. No. 3,416,618 to E. A. Kunnenann assigned to Dresser Industries, Inc. a rotary drill bit for use in the drilling of oil and gas wells or the like with concentric drill pipe is shown. The bit includes a body rotatably supporting a plurality of cutting members that are arranged on the body to disintegrate the bottom of the well bore as the bit is rotated. The body is arranged for connection with each of the concentric drill pipes. A shroud is attached to the body and forms a portion thereof. The shroud has an outside diameter substantially the same as the diameter of the well bore to prevent or at least inhibit fluid flow between the bit and the well bore wall. The shroud is extended downwardly as close to the well bore bottom as possible to increase the efficiency of recovery of the cuttings and to aid in preventing contamination of the cuttings.

In U.S. Pat. No. Re 26,669 to H. I. Henderson reissued Sept. 30, 1969, a drilling bit for use with dual tubing drill pipe earth boring is shown. The drilling fluid descends in the annulus between the dual tubes, thence passes through the bit and ascends within the inner tube, carrying the cuttings and cores, if any, to the earth surface. The shank of the bit is substantially full hole to restrict the drilling fluid from ascending in the hole annulus. The bit's shank may be fluted to permit fluid passage when the bit is off bottom. Such flutes, if any, may carry cutting blades at their tops to facilitate drilling upward when a borehole caves. The bit has bottom cutting blades of a width that will permit intrusion into soft formations to effect cutting action as a drag bit. These same blades are impregnated with hard particles, such as diamonds, which particles protrude and penetrate hard rock formations, that are too hard for the complete blade to penetrate, thus assuring that the bit will cut both soft and hard formations. The base of the bit has tapered sections that progressively place more and more bit surface on the bottom as the blades penetrate deeper into the soft formation, thereby safeguarding complete water course blocking when a bit is overloaded in soft formations. An additional feature to prevent bit blocking is a series of auxiliary transverse water courses within the body of the bit, said auxiliary water courses being transversely slotted to communicate with the bottom of the bit. The bit's jets pass vertically through these auxiliary water courses, In U.S. Pat. No. 3,416,617 to W. D. Elenburg, assigned to Walker-Neer Manufacturing Co., Inc. patented Dec. 17, 1968, a drill bit adapted for use with continuous dual passage drill pipe and including fluid ducts for directing flow from around the inner drill pipe onto the cutting members is shown. A skirt around the cutting members generally restricts flow to the outside of the bit so that almost all return flow is up through the inner pipe. A radial collar further restricts upward flow.

SUMMARY OF THE INVENTION

The present invention provides a rotary drill bit that can be used with a vacuum, vacuum-pressure, or pressure circulation drlling system. The bit of the present invention is adapted to drill in varying formations and operates to effectively remove the drill cuttings. The bit includes a body member rotatably supporting cutter means for disintegrating the formations and forming the desired bore. A shield means projects from the body member proximate the cutter means with at least a first portion of said shield means having an outside diameter substantially equal to the outside diameter of the cutter means and substantially equal to the diameter of the bore and at least a second portion having an outside diameter substantially less than the outside diameter of the cutter means and substantially less than the diameter of the bore. A first passage means extends through the body member to provide fluid flow through the bit and a second passage means extends through the body member to provide fluid flow through the bit. The above and other features and advantages of the present invention will become apparent from a consideration of the following detailed description of the invention when taken in conjunction with the accompanying drawings.

DETAILED DESCRIPTION OF THE INVENTION

Figure 1:
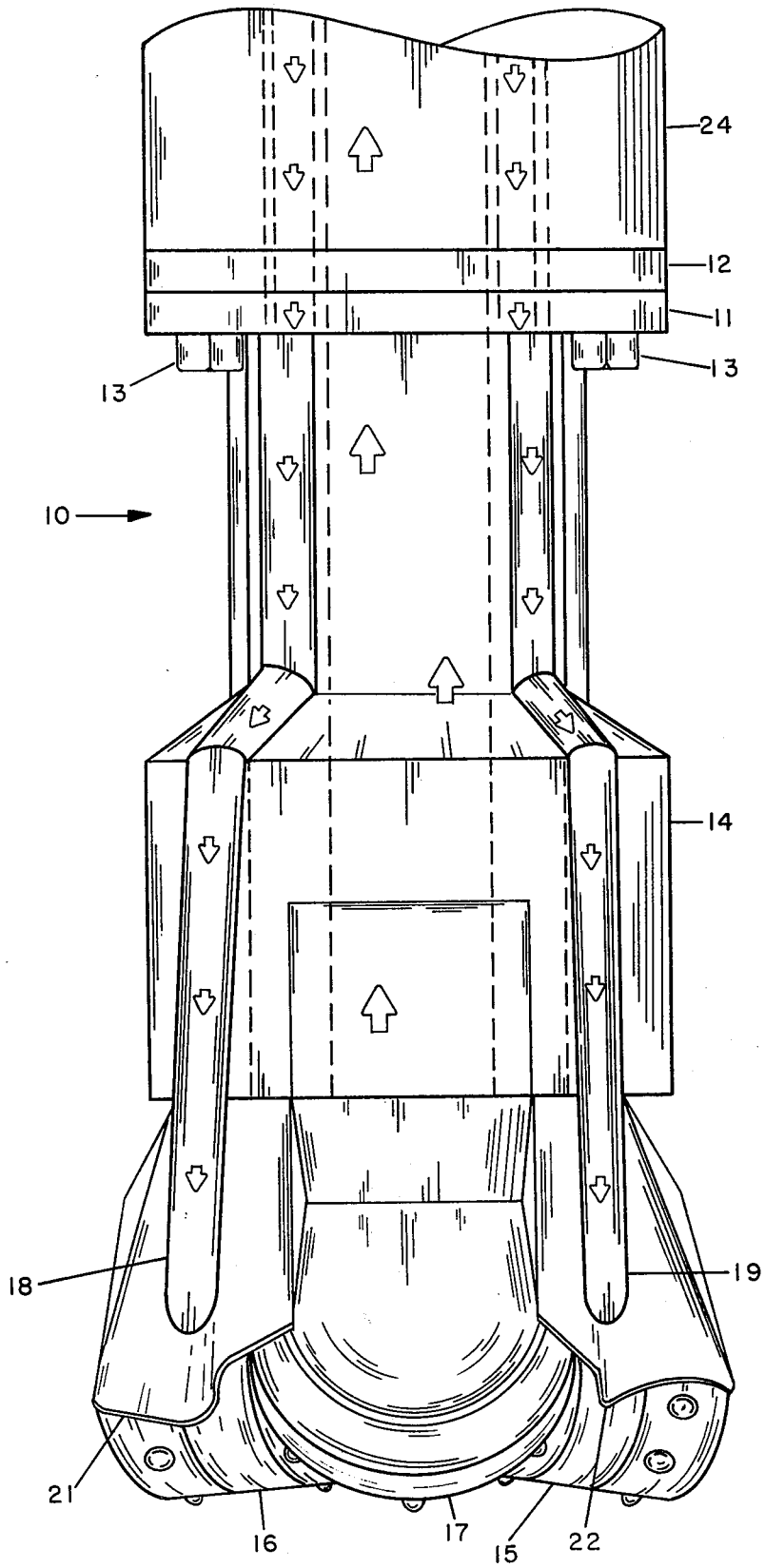
FIG. 1 is a side view of an earth boring bit constructed in accordance with the present invention.

Referring now to the drawings, and in particular to FIG. 1, a side view of an earth boring bit constructed in accordance with the present invention, is shown. The bit generally designated by the reference number 10, includes a bit body 14. As illustrated the bit body 14 is adapted to be connected to a section of drill pipe 24 to form a rotary drill string. A flange 11 on the bit body 14 is positioned adjacent a flange 12 on the section of drill pipe 24. A multiplicity of bolts 13 connected between the flanges 11 and 12 secure the bit 10 to the section of drill pipe 24.

The drill string 24 and bit 10 include a central passage to allow the passage of gaseous fluids, drill cuttings and/or material from the borehole. A tube 19 extends from the rotary drill pipe 24 along the bit body 14 to a position between and proximate the cutters 15 and 17. A tube 18 extends from the rotary drill pipe 24 along the bit body 14 to a position between and proximate cutters 16 and 17. Three individual bearing pins extend from the bit body 14. Each of the bearing pins supports a generally connical cutter member. The cutter members are designated by the reference numbers 15, 16 and 17. Each of the cutter members 15, 16 and 17 includes cutting structures on their periphery for contacting and disintigrating the formations.

Sections 21 and 22 of an annular shield project around the lower end of bit body 14. The shield elements 21 and 22 extend downwardly as close to the bottom of the borehole as possible. A portion of shield section 21 has an outside diameter substantially equal to the bit radius defined by the cutters 16 and 17 and substantially equal to the diameter of the borehole. Another portion of shield section 21 has an outside diameter substantially less than the bit radius defined by the cutters 16 and 17 and substantially less than the diameter of the borehole. A portion of the shield section 22 has an outside diameter substantially equal to the bit radius defined by the cutters 15 and 17 and substantially equal to the diameter of the borehole. Another portion of shield section 22 has an outside diameter substantially less than the bit radius defined by the cutters 15 and 17 and substantially less than the diameter of the borehole.

Figure 2:
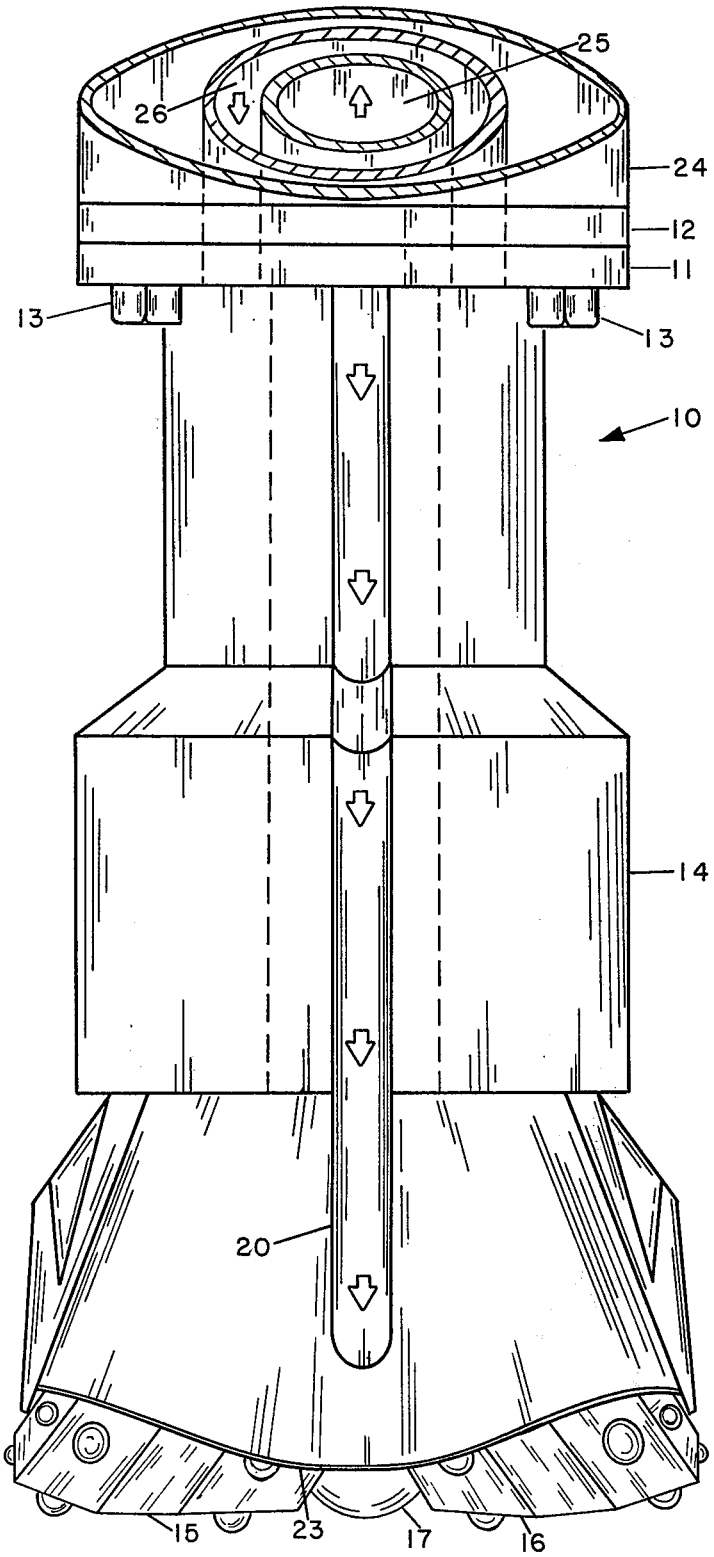
FIG. 2 is a view of the opposite side of the bit shown in FIG. 1.

Referring now to FIG. 2, a view from the opposite side of the earth boring bit 10 is shown. The bit 10 as previously described includes a bit body 14. As illustrated the bit body 14 is adapted to be connected to a section 24 of a rotary drill string. A flange 11 on the bit body 14 is positioned adjacent a flange 12 on the rotary drill string 24. A multiplicity of bolts 13 connected between the flanges 11 and 12 connect the bit 10 to the rotary drill string 24. The drill string 24 and bit 10 include a central passage to allow the passage of gaseous fluids, drill cuttings and material from the borehole. A tube 20 extends from the rotary drill string 24 along the bit body 14 to a position between and proximate cutters 15 and 16.

Three individual bearing pins extend from the bit body 14. Each of the bearing pins supports the connical cutter members 15, 16 and 17. Each of the cutter members 15, 16 and 17 includes cutting structures on their periphery for contacting and disintigrating the formations. Section 23 of an annular shield projects around the lower end of the bit body 14. The shield section 23 extends downwardly as close to the bottom of the borehole as possible. A portion of shield section 23 has an outside diameter, substantially equal to the bit radius defined by the cutters 15 and 16 and substantially equal to the diameter of the borehole. Another portion of shield section 23 has an outside diameter substantially less than the bit radius defined by the cutters 15 and 16 and substantially less than the diameter of the borehole.

Figure 3:
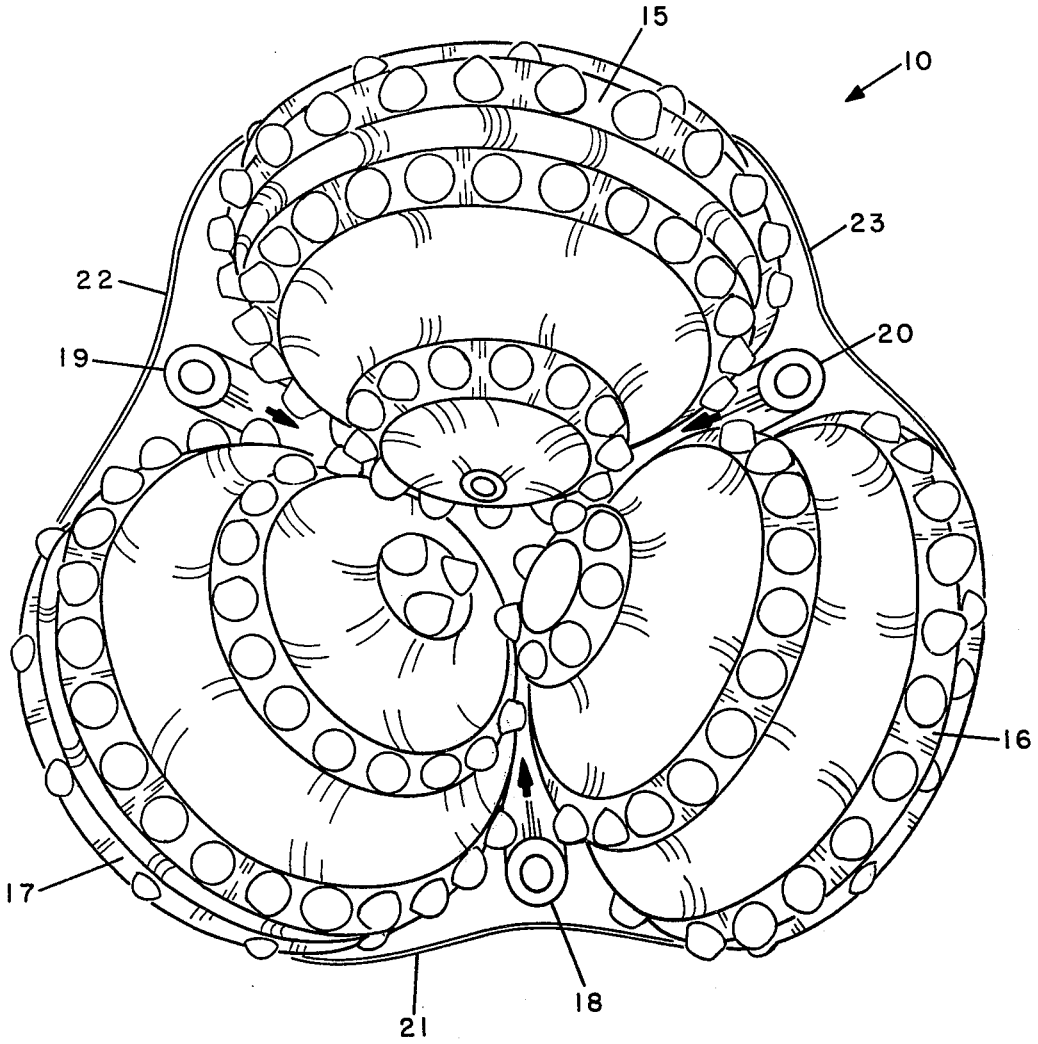
FIG. 3 is a bottom view of the bit shown in FIGS. 1 and 2.

Referring now to FIG. 3, a bottom view of the bit 10 is shown. The cone cutters 15, 16 and 17 are spaced equally around the radius of the bit body. The shield elements 21, 22 and 23 project downward around the periphery of the bit 10 thereby forming an annular shroud. A portion of each of the respective shields 21, 22 and 23 has an outside diameter substantially equal to the outside diameter of the bit as defined by the cutters 15, 16 and 17, and substantially equal to the diameter of the borehole. The respective shield elements 21, 22 and 23 also have a portion that is substantially less than the outside diameter of the bit 10 and substantially less than the diameter of the borehole. The tubes 18, 19 and 20 extend through shields 21, 22 and 23 and project between the respective cutters.

The structural details of an earth boring bit 10 constructed in accordance with the present invention having been described, the operation of the bit 10 will now be considered with reference to FIGS. 1, 2 and 3. The bit 10 provides a rotary drill bit that can be used with a vacuum, vacuum-pressure or a pressure circulation drilling system. Bit 10 is adapted to drill in varying formations and operate to effectively remove the drill cuttings from the borehole by insuring that the cuttings will be lifted off bottom and entrained with the circulating fluid.

As shown best in FIG. 2, the drill string section 24 includes a central or inner passage 25 and an intermediate annulus 26 between a middle tube and the central tube. During vacuum, pressure assisted drilling, the inner passage 25 is in communication with a vacuum source, thereby drawing air upward in the central passage 25. The intermediate annulus 26 is connected with a source of air pressure to force air downward in the annulus 26. The tubes 18, 19 and 20 are connected to the annulus 26. The air travels downward through the annulus 26 into the tubes 18, 19 and 20 and is directed downward to the bottom of the borehole, thereby lifting the cuttings off bottom and allowing the cuttings to be circulated upward in the air being drawn upward in the passage 25 by the vacuum. The shield elements 21, 22 and 23 allow air from around the outside of the bit and the drill string to be drawn downward and circulate between the cutters 15, 16 and 17, thereby assisting in lifting the cuttings off bottom and allowing them to become entrained with the air being drawn upward in the passage 25 by the vacuum. The portion of the shield elements 21, 22 and 23 that is substantially less than the diameter of the bit and the diameter of the borehole, allows the air between the wall of the borehole and the drill string to circulate between the cutters 15, 16 and 17. The shield elements insure that this air must necessarily circulate proximate the bottom of the borehole, thereby lifting the cuttings off bottom.

Bit 10 facilitates the removal of drill cuttings from the borehole. The cuttings may vary in size from relatively large diameter pieces to powder-like particles. Water or other substance may also infiltrate into the borehole and must be removed. The walls of the borehole must remain intact and rate of penetration of the bits during drilling should be sufficient to allow the drilling of a large number of holes over a reasonable time period.

In use, the bit 10 is connected to the section of the drill string 24. The drill string is lowered into the borehole until the cutters 15, 16 and 17 contact the bottom of the hole. Upon engaging with the bottom of the hole, the drill string is rotated, rotating the bit 10 therewith. As the bit 10 rotates about the bit axis of rotation, each of the cutters 15, 16 and 17 rotate about their axes of rotation respectively. The cuttings structure on the cutters 15, 16 and 17 disintegrate the earth formations forming drill cuttings which may vary in size from large pieces to powder-like cuttings. The cuttings must be removed from the borehole. The bit 10 is especially effective when used in suction or vacuum induced reverse circulation drilling and pressure assisted vacuum drilling. A vacuum is created in the central passage 25 of the rotary drill string, thereby inducing a vacuum in the central passage in the bit body 14. Air or other gas from a pressure source travels through annulus 26 and enters the tubes 18, 19 and 20 striking the bottom of the borehole to insure that the cuttings will be lifted off bottom. The cuttings are drawn into the central passage in the bit body 14 into the central passage 25 in the drill string and carried upward to the surface.

The embodiments of the invention in which an exclusive property or privilege is claimed, are defined as follows:

1. A rotary drill bit for forming a bore, comprising:

cutter means for forming the bore, said cutter means including a plurality of cutter members;

a body member rotatably supporting said cutter means, said body member having one end and another end, said body member supporting said cutter members in spaced relationship to engage and disintegrate the bottom of the bore upon rotation of said bit;

said body member having shield means projecting from said body member that projects proximate said cutter means with at least a first portion of said shield means having an outside diameter substantially equal to the outside diameter of said cutter means and substantially equal to the diameter of the bore, and at least a second portion having an outside diameter less than the outside diameter of said cutter means and less than the diameter of the bore;

a first passage means extending through said body member; and a second passage means spaced from said first passage means extending from one end to the other end of said body member.

2. A rotary drill bit for forming a bore or the like, said rotary drill bit having a bit axis of rotation, comprising:

cutting means for forming the bore, said cutting means including a plurality of cutting members, a body member rotatably supporting said cutting means, said body member having one end and another end, said body member supporting said cutting members in spaced relationship to engage and disintegrate the bottom of the bore upon rotation of said bit, said body member having shield means projecting from said body member that projects proximate said cutting means with a portion of said shield means having an outside diameter substantially equal to the outside diameter of said cutting means and substantially equal to the diameter of the bore, and a portion having an outside diameter substantially less than the outside diameter of said cutting means and substantially less than the diameter of the bore, a first passage means extending through said body member along said bit axis of rotation, and a second passage means extending from one end to the other end of said body member spaced from said bit axis of rotation.

3. A rotary drill bit for forming a well bore or the like, said bit comprising:

a bit body having one end, another end and three arms, each said arm including a bearing shaft;

first, second and third cutter members journaled on a respective one of said bearing shafts;

shield means projecting from said bit body that projects proximate said cutter members with a portion of said shield means having an outside diameter substantially equal to the outside diameter of said cutter members and substantially equal to the diameter of the bore, and a portion having an outside diameter substantially less than the outside diameter of said cutter members and substantially less than the diameter of the bore;

a first passage means extending through said bit body; and a second passage means spaced from said first passage means extending from one end to the other end of said bit body.

* * * * *